United States Patent [19]

Coen et al.

[11] 4,108,473

[45] Aug. 22, 1978

[54] PERFECT BOUND SAMPLE BOOK WITH INTEGRAL HANDLE

[75] Inventors: Manus Coen, Passaic; Joseph Bonfield, Clifton, both of N.J.

[73] Assignee: Eastern Bindery, Inc., Paterson, N.J.

[21] Appl. No.: 731,426

[22] Filed: Oct. 12, 1976

[51] Int. Cl.[2] ..... B42D 3/00

[52] U.S. Cl. ..... 281/29; 206/472; 224/45 N

[58] Field of Search ..... 224/45 N, 50–58; 281/29, 32, 34–37; 206/472

[56] References Cited

U.S. PATENT DOCUMENTS

| | | | |
|---|---|---|---|
| 1,569,381 | 1/1926 | Lewis | 281/29 |
| 2,167,363 | 7/1939 | Hoenigsberger | 224/47 X |
| 2,786,281 | 3/1957 | Kramer et al. | 281/29 |
| 3,159,411 | 12/1964 | McKowen | 281/36 X |
| 3,167,328 | 1/1965 | Dengle et al. | 281/29 |
| 3,514,875 | 6/1970 | Howard | 206/473 X |
| 3,617,074 | 11/1971 | Rigolini | 281/34 |

*Primary Examiner*—Albert J. Makay
*Assistant Examiner*—D. W. Underwood
*Attorney, Agent, or Firm*—Edward R. Weingram

[57] ABSTRACT

A perfect bound sample book has an internal spine directly connected to and binding the pages of the book. Mounting projections from the internal spine project through the cover of the book for direct attachment to a pivotally mounted carrying handle.

20 Claims, 10 Drawing Figures

PERFECT BOUND SAMPLE BOOK WITH INTEGRAL HANDLE

BACKGROUND OF THE INVENTION

1. Field of the Invention

This invention relates to sample books and, more specifically, to perfect bound sample books having handles to facilitate carrying the book.

2. Description of the Prior Art

The makers and users of sample books have long been faced with the problem of providing a sample book which can be fully and easily opened to provide a full view of the book's contents and yet be sturdy and durable enough to be easily handled and transported. Sample books, such as those containing wallpaper or other surface coverings, are usually relatively bulky and heavy. Collections of these books are often kept on shelves in showrooms, so that when a person desires to view the book, the book has to be taken from the shelf, carried to a desk or table for viewing, and then returned to the shelf. Often, too, books will be taken from the showroom and transported to the location where the merchandise shown in the books is intended for installation. Because of the nature of the use of sample books as described above, it is important that the books be provided with an effective means for carrying and otherwise handling the books.

Prior attempts to provide a sample book which can be fully opened and easily handled, transported, and stored have been less than successful. A perfect binding, i.e. a binding in which single leaves are held together with a backbone adhesive, is the most desired binding from the point of view of allowing for easy and full opening of the pages in a book. However, this type of binding has relatively poor durability and has generally proven unsuccessful when used in the large sample books.

Therefore, makers of large sample books have had to resort to using relatively crude binding methods such as nailing the covers to the pages of the books, in order to produce a product durable enough to meet the demands placed on the books during normal use. However, the cruder form of binding also puts limitations on the performance of the book.

An example of a construction which interferes with the normal function of the book is that in which the cover of the book is designed to serve as the main weight-bearing structure of the book, as by nailing the cover to the pages of the book. In such circumstances, because the cover serves as the main weight-bearing member for the book, the cover requires a relatively large apron, or non-opening segment, on the front and/or the back portion. This non-opening segment will prevent the book from lying flat when opened. Accordingly, the large apron, or non-opening section, of the cover will restrict the turning freedom of the pages held in the cover and, therefore, reduce the area of each page in the book that can be effectively and conveniently viewed by the person using the book.

Attempts have been made to place handles on the spine or back surface of the covers of sample books. However, this type of construction resulted in all the weight of the book being borne by the cover of the book, which tended to place too great a stress on the members which fastened the cover to the pages of the book. Therefore, it was common for the cover to separate from the remainder of the book, making the book unusable.

Attempts have been made to fasten one or more straps to the front and back cover of the book, across the spine of the book, in order to serve as a handle. However, this type of handle is inherently unbalanced when supporting the book. For example, when the book is being carried, the handle will tend to lie in the plane of the palm of the hand of the person carrying the book. This is normally parallel to the path of movement of the adjacent leg of the person when he is walking. Therefore, when a book with the crossover strap is carried, the book tends to rotate, so that at least one end of the book projects into the path of movement of the person's leg, causing a constant bumping of the knee against the book.

Other attempts at providing a sample book with a convenient handle means have resulted in constructions which interfere with normal use of the book. One example of such construction is where the handling means consists of one handle member extending beyond the spine of the book on either side of the front and back covers, which are usually secured to the book through the cover. However, this type of handle usually cannot be easily moved to a position where it will not interfere with the placing of the book on a flat surface in order to properly view the contents of the book. Instead, the handles usually protrude, making the book somewhat unstable when placed on a table.

SUMMARY OF THE INVENTION

In order to overcome the problems of the prior art, the present invention sets forth a perfect bound sample book which is constructed with an internal spline directly connected to the pages of the book. Mounting means project from the internal spine through the cover of the book disposed about the spline, to provide for direct pivotal attachment of a handle to the internal spline to support the pages of the book. The fastening of a handle to the mounting means from the internal spline effectively positions the cover with relation to the pages of the book and the internal spine.

A method is also set forth for producing a perfectly bound sample book with an integral handle in which the pages of the book are bonded together to an internal spine which is then fastened to the cover of the book by attaching the handle to the internal spine.

Accordingly, in view of the above, it is an object of the present invention to provide a perfect bound sample book which includes a handle that is securely anchored into the binding of the book and does not rely upon attachement to the cover of the book for its primary support.

It is another object of the present invention to provide a perfect bound sample book having a handle which is securely fastened to the book with a minimum of external connecting members.

Still another object of the present invention is to provide a perfect bound sample book having a handle which is relatively flexible and can be moved between a carrying position and a rest position without any difficulty and will produce minimal interference with the use of the book when the book and handle are both laid in the flat position.

It is yet another object of the present invention to provide a perfect bound sample book having a handle in which the handle is balanced with relation to the book, so that the book can be easily carried without banging or jostling.

A further object of the present invention is to provide a perfect bound sample book having a handle which does not put excessive strain on the cover to support the book when the book is being carried.

It is an additional object of the present invention to provide a perfect bound sample book having a handle which does not interfere with the binding of the book so as to prevent the free opening of the pages in the book.

Another object of the present invention is to provide a perfect bound sample book having a handle which is not anchored directly to the cover of the book.

It is still another object of the present invention to provide a perfect bound sample book having a handle which does not detract from the binding qualities of the book.

Yet another object of the present invention is to provide a perfect bound sample book having a handle which is of a durable construction.

It is a further object of the present invention to provide a perfect bound sample book having a handle which book can be easily fabricated.

An additional object of the present invention is to provide a perfect bound sample book having a handle which book can be fabricated relatively inexpensively.

It is another object of the present invention to provide a perfect bound sample book having a handle in which the handle and the handle connection are relatively strong.

Still another object of the present invention is to provide a perfect bound sample book having a handle, in which the handle is relatively comfortable.

An additional object of the present invention is to provide a method of fabricating a perfect bound sample book having a handle, which method binds the single leaves of the book together with an internal spine member.

It is still another object of the present invention to provide a method of fabricating a perfect bound sample book having a handle, which attaches the mounting means for the handle concurrently with the binding of the individual leaves of the book.

Yet another object of the present invention is to provide a method of fabricating a perfect bound sample book having a handle, which does not bind the individual leaves of the book to the cover.

It is a further object of the present invention to provide a method of fabricating a perfect bound sample book having a handle, which is relatively simple, fast and can be performed by persons relatively unskilled in the bookbinding art.

Other objects and advantages will be apparent from the following description of several embodiments of the invention, and the novel features will be particularly pointed out hereinafter in connection with the appended claims.

DESCRIPTION OF THE PREFERRED EMBODIMENT

Figure 1:
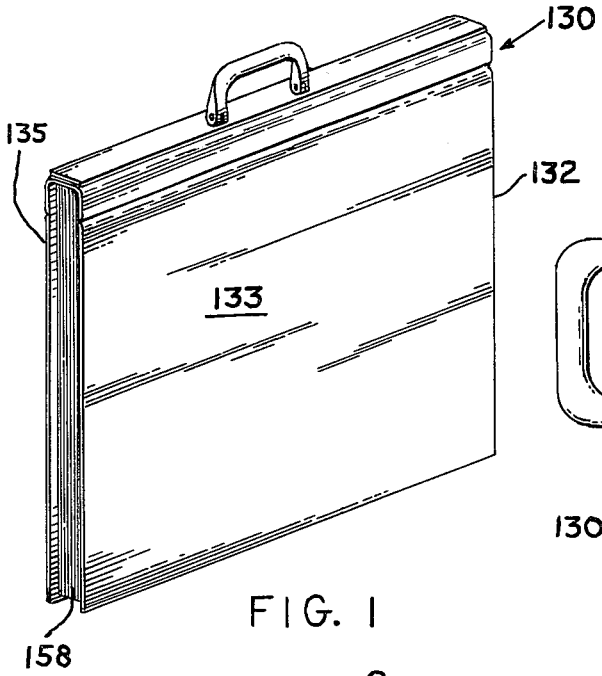
FIG. 1 is a perspective view of a sample book built in accordance with the teachings of the present invention.
Figure 2:
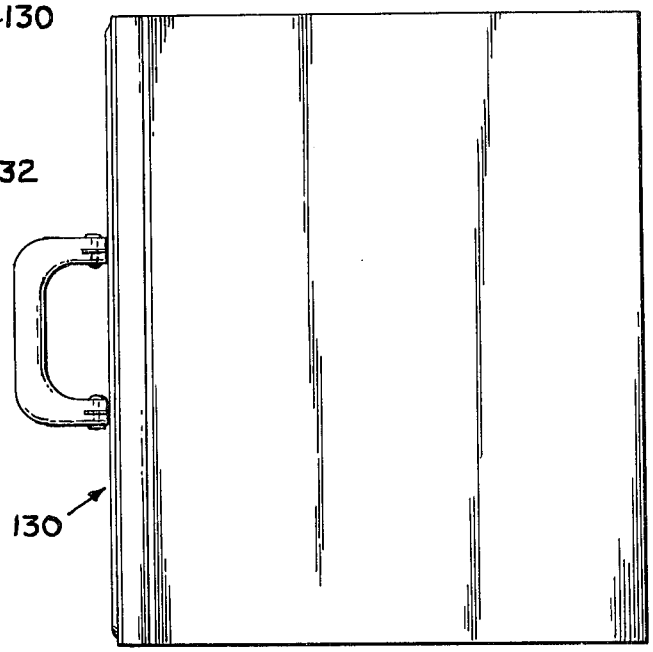
FIG. 2 is a front elevation of the book shown in FIG. 1.
Figure 3:
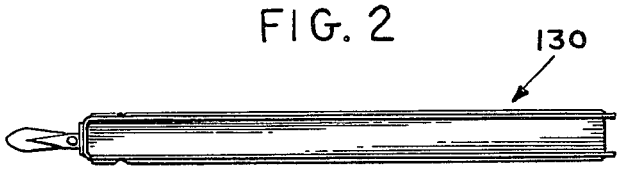
FIG. 3 is an end view of the book shown in FIG. 1.
Figure 4:
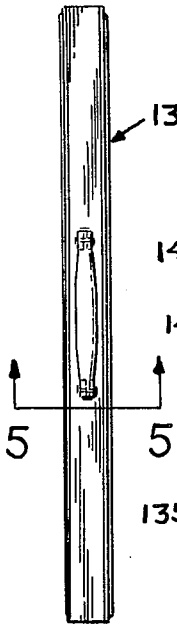
FIG. 4 is a top view of the book shown in FIG. 1.
Figure 5:
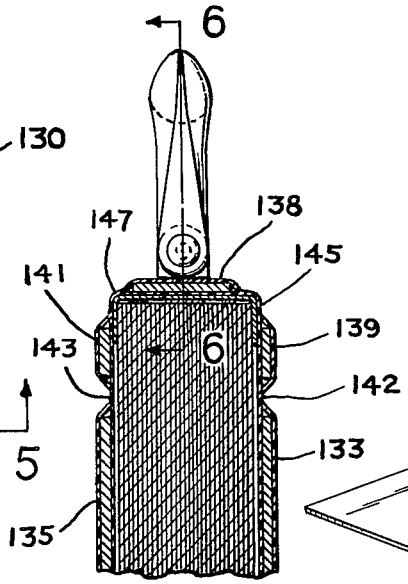
FIG. 5 is a view taken along lines 5—5 of FIG. 4.
Figure 7:
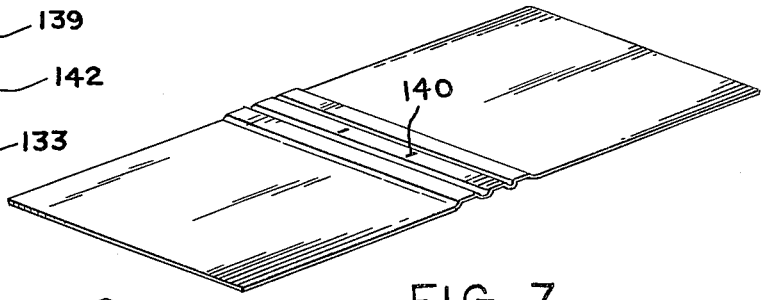
FIG. 7 is a perspective view of the cover used for the book shown in FIG. 1, with the cover in the open position.
Figure 8:
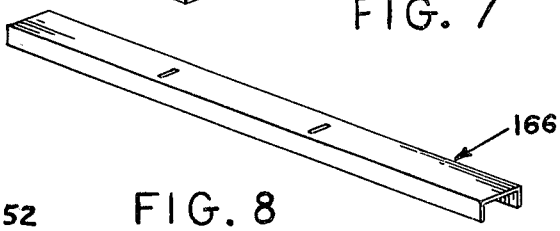
FIG. 8 is a perspective view of an internal spine member used in the fabrication of the book.
Figure 9:
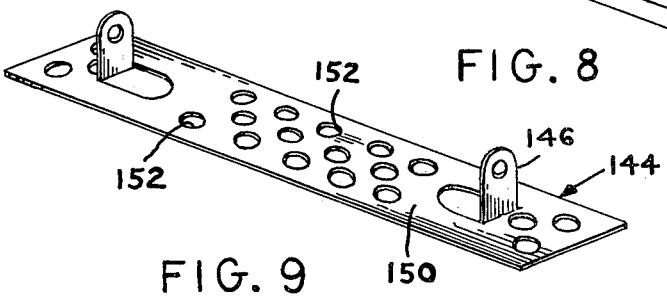
FIG. 9 is a perspective view of a carrier member used in the fabrication of the book.
Figure 10:
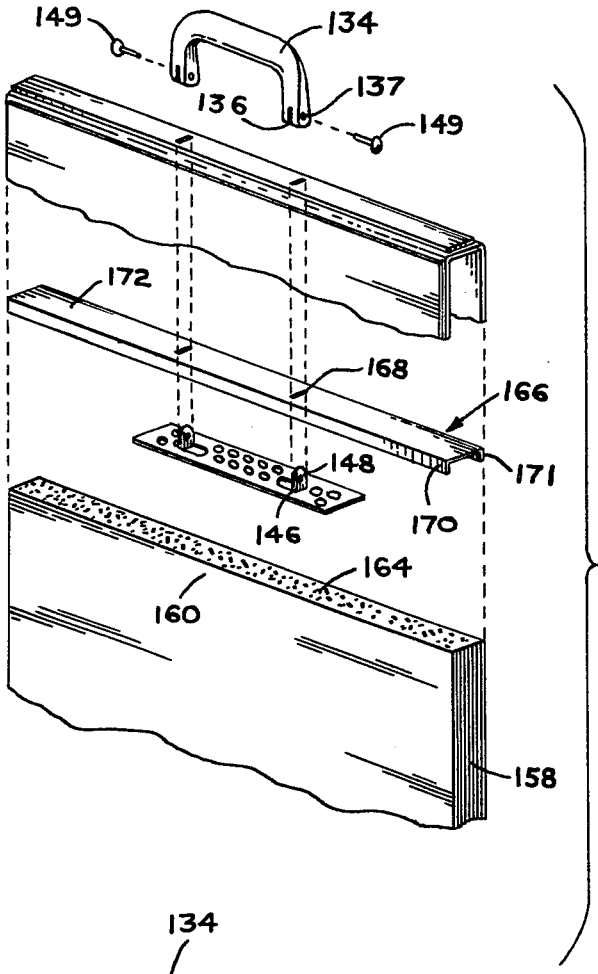
FIG. 10 is an exploded view of a portion of the perfect bound book shown in FIG. 1.
Figure 6:
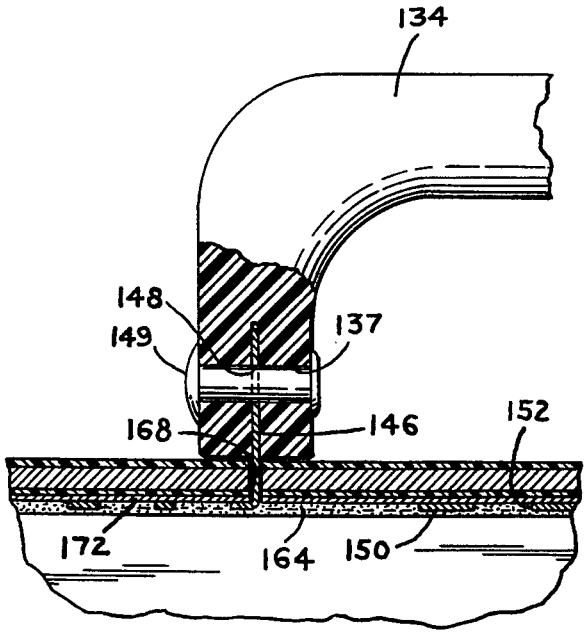
FIG. 6 is a view taken along lines 6—6 of FIG. 5.

Referring now to FIGS. 1 through 10, a book, generally indicated at 130 consists of a bundle of leaves 158, surrounded by a cover generally indicated at 132 having front and back leaves 133 and 135 pivoting along hinge lines 142 and 143 respectively from aprons 139 and 141 respectively, which in turn extend through bends 145 and 147 respectively with spine portion 138 of the cover.

A handle 134 is mounted to a carrier member generally indicated at 144 by means of fingers 146 extending upward from the carrier through corresponding slots 140 in the spine 138 of cover 132 and slots 168 in internal spine 166 which is glued to and forms a unit with carrier 144 as will be explained below. The fingers 146 extending from carrier 144 mate with slots 136 in the end of each handle and are fastened in the slots by means of rivets 149 which pass through aligned fastening holes 148 in the fingers 146 extending from carrier 144 and rivet holes 137 in the ends of the hande.

Carrier 144 has a flat surface 150 with a plurality of bonding passages 152 formed therein. It is adpated to be positioned on the top edge 160 of leaf bundle 158 to which a layer of bonding material 164 has been applied. The bonding material can be applied either directly to the top of the leaf bundle, or it can be applied by coating it on the inside of back surface 172 of internal spine 166, into which the carrier is then placed with fingers 146 extending through slots 168, and then placing leaf bundle 160 into the internal spine 166 so that the arms 170 and 171 of the internal spine extend slightly down the sides of leaf bundle 158.

After the internal spine has been positioned over the carrier and the leaf bundle, the cover 132 can then be placed over the leaf bundle and fastened to the carrier, so as to have fingers 146 extend through the corresponding slots 140 in the spine 138 of the cover. The handle 134 is then fitted over the extended fingers, and rivets 149 installed to lock the handle to the fingers, thereby also locking the cover in position. In this position, the cover would be free to open completely, regardless of the binding method used for the page bundle. For example, the hinge lines for the cover leaves could be at the bends of the spine 138 rather than at the end of the aprons. However, this would allow all of the internal spine and other items to clearly show, which may be considered undesirable.

Accordingly, means are provided to fasten the apron portions of the cover 141 and 139 to the arms 170 and 171 of the internal spine.

Note the handle 134 is pivotally fastened to the fingers 146 of carrier 144 by means of rivets 149 or suitable, securable fastening means, passing through aligned passages 137 and 148 in the handle and fingers respectively. After the rivet blank is passed through the aligned passages, it is processed to secure it in place.

It should be apparent that the handle directly supports the leaf bundle of the book and does not rely upon any connection with the cover of the book in order to provide support. Any connection between the internal spine 166 and the cover 132 of the book is only to prevent relative motion between these two elements which might be disconcerting to the user of the book and also to mask the binding of the leaf bundle.

As can be seen from the above description, the finished product is a strongly constructed book, having a stiff spine from which are securely fastened the leaves of the book. The handle 134 is connected directly to the spine by means of the carrier which is bonded between the top edge of the leaf bundle and the internal spine 166. The handle is not connected in any way to the cover of the book, so that any use of the handle will not impart a stress to the cover of the book. The front and back leaves of the cover 133 and 135 respectively are free to swing freely on hinge lines 142 and 143 to open wide, allowing the book to lie flat when placed on a flat surface. For even greater rigidity, the top surface 172 of spine 166 could be bonded to the bottom of the cover spine 138, but this is in no way necessary to add to the strength of the product.

Briefly stated then, the method of fabricating the book can be set forth as follows. First, the leaves of the book are clamped to form a bundle; then a bonding agent is applied to the inner surfaces of the internal spine. The carrier is then positioned within the internal spine with the fingers extending through the slots in the spine. The spine is then fitted over the top of the leaf bundle and the bonding agent allowed to set. The cover is next fitted over the internal spine and locked in position by means of fastening the handle to the fingers extending from the carrier through the corresponding slots in the cover and internal spine.

From the standpoint of simple ease of operation, the procedure of coating the inside surfaces of the internal spine with a suitable bonding agent is an efficient manner of placing the bonding agent on the edge of the leaf bundle, and securing the carrier to the leaf bundle. However, alternatively, the bonding agent can be directly applied to the edge of the leaf bundle, and the carrier positioned on the coated edge of the leaf bundle, either before or after the carrier is positioned with respect to the internal spine, by extending the carrier fingers through the slots in the internal spine. Then the cover can be fastened to the carrier by extending the fingers of the carrier through the slots in the cover and fixing the handle to the fingers.

To facilitate the bonding of internal spine 166 to the leaf bundle 158, grooves or serrations can be formed on the inner and/or outer surfaces of internal spine 166.

From the above description of the invention, several advantages of the invention should be apparent. All of the books described have a handle which can be perfectly positioned and aligned on the spine of the cover so that the book will be in perfect balance when being carried by a person. The book would not have a tendency to swing into the path of the person's leg as he walked, nor would it have a tendency to drop the front or rear portion because of the uneven position of the handle.

Further, the fingers extending through the spine of the book extend only far enough to allow for mounting of the handle with a small amount of clearance space. Therefore, when the book is laid flat on a table and the handle placed in the flat position, the book is relatively stable, and will not have a tendency to rock back and forth as pages are turned, as would be the case if the handle were of a much larger projection than in the present case.

Note also that since the handle can be easily turned to the side in a relatively flat position with relation to the spine of the books, that the books can be more easily stored in a shelf area without numerous projections extending beyond the storage shelves, which projections may post hazards to personnel who have to work in the proximity of the shelves.

Obviously, the construction of the book and handle assembly offers many distinct advantages. First, the handle is securely fastened directly to the strongest members in the assembly, namely the carrier and the internal spine member. The handle does not in any way depend on the cover for any of its mounting strength. The cover can be fastened directly to the back of the leaf bundle by means of any convenient bonding agent or other means, if desired, solely for the purpose of immobilizing the cover, since any movement between the cover and the pages would be disconcerting to the user of the book.

Additionally, by freeing the cover from any load-bearing responsibility with relation to the handle of the book or the means for carrying the book, the cover can be spread more freely and, therefore, open to a wider extent than is normally possible with the covers of existing sample books. Further, the increased spreadability of the cover can allow for easier and increased spreadability of the pages in the book. This, therefore, provides for a more effective presentation of the material on the page and, in effect, a larger viewing area of each page in the book.

It should also be pointed out that the assembly of the book as described above is relatively quick, requiring a minimum of precision steps and a minimum of time-consuming steps. Therefore, it is relatively inexpensive and can be accomplished by personnel with a minimum of skill in this art.

It will be understood that various changes in the details, materials and arrangements of parts which have been herein described and illustrated in order to explain the nature of the invention may be made by those skilled in the art within the principle and scope of the invention, as expressed in the appended claims.

What is claimed is:

1. A perfect bound sample book comprising:

a leaf bundle;

a carrier;

bonding means, fastening said carrier to said leaf bundle at the back of said leaf bundle;

a cover having a spine with passage means therein, said cover disposed about said carrier so as to position said carrier between said cover and said leaf bundle;

mounting means on said carrier extending away from said leaf bundle, and passing through said passage means in said cover and extending beyond said cover;

handle means;

means connecting said handle means to said mounting means on said carrier externally of said cover so that said handle means is connected to said leaves of said book through said carrier, to directly support the leaf bundle independently of the cover.

2. A perfect bound sample book according to claim 1 further comprising:

an internal spine disposed between said leaf bundle and said cover;

said bonding means fastening said internal spine to said leaf bundle and said carrier, 3. A perfect bound sample book according to claim 2 wherein said internal spine further comprising:

a back portion;

downwardly extending arms on both sides of said internal spine back portion;

passage means formed in said back portion of said internal spine for passing said mounting means on said carrier through said internal spine.

4. A perfect bound sample book according to claim 1 wherein said carrier comprises:

a flat surface;

a pair of fingers extending upward from said flat surface adapted to engage the handle for said book, said fingers comprising said mounting means;

a plurality of bonding passages adapted to permit passage of bonding means to both sides of said carrier.

5. The perfect bound sample book according to claim 4 further comprising an internal spine which comprises:

a back portion;

downwardly extending arms on both sides of said internal spine back portion;

passage means formed in said back portion of said internal spine for passing said mounting means on said carrier through said internal spine.

6. The perfect bound sample book according to claim 5 wherein:

said passage means in said internal spine means comprised slot means in registration with said mounting means on said fingers;

said passage means in said cover spine comprising slot means in registration with said mounting means.

7. The perfect bound sample book according to claim 1 wherein:

said mounting means on said carrier extending through said cover comprise;

a pair of fingers extending in parallel relation from said carrier;

said fingers having passages formed therein perpendicular to the direction of extension of said fingers for receiving fastening means therein; and wherein said means connecting said handle means to said mounting means on said carrier comprised:

a pair of arms formed on said handle;

in each of said arms on said handle a passage formed dimensioned to register with the passage means in said fingers extending from said carrier for pivotally fastening said handle to said fingers extending from said carrier.

8. The perfect bound sample book according to claim 7 wherein said means connecting said handle means to said mounting means further comprise slot means in each arm of said handle, disposed perpendicular to said fastener passage means in said handle and dimensioned to receive said mounting fingers extending from said carrier.

9. The perfect bound sample book according to claim 3 wherein said means connecting said handle means to said mounting means further comprise slot means in each arm of said handle, disposed perpendicular to said fastener passage means in said handle and dimensioned to receive said mounting fingers extending from said carrier.

10. The perfect bound sample book according to claim 6 wherein said means connecting said handle means to said mounting means further comprise slot means in each arm of said handle, disposed perpendicular to said fastener passage means in said handle and dimensioned to receive said mounting fingers extending from said carrier.

11. The method of fabricating a perfect bound sample book comprising the steps of:

forming a group of leaves into a leaf bundle having a substantially planar back surface;

positioning a carrier against the planar back surface of the leaf bundle with mounting means on said carrier extending from said carrier away from said planar back surface;

bonding said carrier to the leaf bundle at the planar back surface of said leaf bundle to support the leaf bundle and to binde the leaf bundle;

positioning a cover about the carrier and the leaf bundle with the mounting means of the carrier passing through passages in the cover alligned with said mounting means, the mounting means extending beyond the cover;

fastening a handle directly to said mounting means passing through the passages in the cover to directly support the leaf bundle via the carrier independently of the cover, and to position the cover with relation to the leaf bundle.

12. The method for fabricating a perfect bound sample book according to claim 11 wherein: the step of bonding the carrier to the leaf bundle comprises the step of positioning an inner spine over the carrier with a portion of the carrier extending through passages in the inner spine for fastening to the handle.

13. The method of fabricating a perfect bound sample book according to claim 11 wherein the step of fastening a handle directly to the carrier extending through the cover comprises the steps of:

passing a fastening means through aligned passages in the handle and the part of the carrier extending through the cover; and securing the fastening means in place to pivotally fasten the handle to the carrier.

14. The method of fabricating a perfect bound sample book according to claim 11 wherein the step of bonding a carrier to the leaf bundle comprises the steps of:

applying a coating of bonding agent directly to the edge of the leaf bundle;

positioning the carrier on the coated leaf bundle;

aligning the carrier on the coated leaf bundle to enable registration of the part of the carrier that extends through the cover with the passages in the cover.

15. The method of fabricating a perfect bound sample book according to claim 12 wherein the step of bonding a carrier to the leaf bundle comprises the steps of:

applying a coating of bonding agent directly to the edge of the leaf bundle;

positioning the carrier on the coated leaf bundle;

positioning the inner spine over the carrier with part of the carrier extending through passages in the inner spine for fastening to the handle.

16. The method of fabricating a perfect bound sample book according to claim 12 wherein the steps of bonding the carrier to the leaf bundle comprise the steps of:

applying a coating of bonding agent to the inner spine;

positioning the carrier and the inner spine on the leaf bundle.

aligning the carrier and the inner spine on the leaf bundle to enable registration of the part of the carrier that extends through the cover with the passages in the cover.

17. The method of fabricating a perfect bound sample book according to claim 14 wherein prior to the step of positioning the carrier on the coated leaf bundle, further comprising the step of positioning the carrier in an inner spine with the part of the carrier extending through the inner spine for fastening to the handle.

18. The method of fabricating a perfect bound sample book according to claim 16 wherein prior to the step of applying a coating of bonding agent to the inner spine further comprising the step of positioning the carrier in the inner spine with the part of the carrier extending through the inner spine for fastening to the handle.

19. The method of fabricating a perfect bound sample book according to claim 17 wherein the step of fastening the handle directly to the carrier extending through the cover comprises the steps of:

passing a fastener means through aligned passages in the handle and the part of the carrier extending through the cover; and securing the fastener means in place to pivotally fasten the handle to the carrier.

20. The method of fabricating a perfect bound sample book according to claim 18 wherein the step of fastening the handle directly to the carrier extending through the cover comprises the steps of:

passing a fastening means through aligned passages in the handle and the part of the carrier extending through the cover; and securing the fastening means in place to pivotally fasten the handle to the carrier.

* * * * *